US006839988B2

(12) United States Patent
Gessay et al.

(10) Patent No.: US 6,839,988 B2
(45) Date of Patent: Jan. 11, 2005

(54) DRILLING APPARATUS FOR HARD GROUND

(75) Inventors: Jean-Claude Gessay, Nanterre (FR); Philippe Chagnot, Nanterre (FR)

(73) Assignee: Compagnie Du Sol, Nanterre (FR)

( * ) Notice: Subject to any disclaimer, the term of this patent is extended or adjusted under 35 U.S.C. 154(b) by 164 days.

(21) Appl. No.: 10/221,391

(22) PCT Filed: Mar. 6, 2001

(86) PCT No.: PCT/FR01/00652

§ 371 (c)(1),
(2), (4) Date: Sep. 11, 2002

(87) PCT Pub. No.: WO01/68990

PCT Pub. Date: Sep. 20, 2001

(65) Prior Publication Data

US 2003/0074810 A1 Apr. 24, 2003

(30) Foreign Application Priority Data

Mar. 13, 2000 (FR) ..... 00 03156

(51) Int. Cl.[7] ..... E02F 3/24; E21B 4/00

(52) U.S. Cl. ..... 37/189; 37/94; 175/98; 175/99; 299/59

(58) Field of Search ..... 37/189, 190, 91, 37/94; 175/91, 96–99, 107; 299/85.2, 59, 81.3

(56) References Cited

U.S. PATENT DOCUMENTS

| | | | | | |
|---|---|---|---|---|---|
| 2,637,527 | A | * | 5/1953 | Andrews, Jr. | 175/94 |
| 3,357,506 | A | * | 12/1967 | de Bosredon | 175/99 |
| 3,443,648 | A | * | 5/1969 | Howard | 175/103 |
| 3,710,878 | A | * | 1/1973 | Endo et al. | 175/66 |
| 3,773,121 | A | * | 11/1973 | Ikeda | 175/95 |
| 3,894,587 | A | * | 7/1975 | Sourice | 175/91 |
| 4,202,416 | A | * | 5/1980 | Blaschke et al. | 175/94 |
| 4,314,615 | A | * | 2/1982 | Sodder et al. | 175/94 |
| 4,373,278 | A | * | 2/1983 | Myrick | 37/340 |
| 4,694,915 | A | * | 9/1987 | Bauer et al. | 175/91 |
| 4,742,876 | A | * | 5/1988 | Barthelemy et al. | 175/7 |
| 4,744,425 | A | * | 5/1988 | Hentschel | 175/73 |
| 4,824,176 | A | * | 4/1989 | Barre | 299/59 |
| 5,056,242 | A | * | 10/1991 | Miotti | 37/94 |
| 5,836,089 | A | * | 11/1998 | Lipsker | 37/186 |
| 6,443,227 | B1 | * | 9/2002 | Hocking et al. | 166/250.1 |
| 6,446,364 | B1 | * | 9/2002 | Herrero Codina | 37/187 |

FOREIGN PATENT DOCUMENTS

| | | |
|---|---|---|
| JP | 61270773 | 5/1988 |
| JP | 01207566 | 3/1991 |
| JP | 04285371 | 4/1994 |
| NL | 1007263 | 4/1999 |

* cited by examiner

*Primary Examiner*—Thomas B. Will
*Assistant Examiner*—Thomas A Beach
(74) *Attorney, Agent, or Firm*—James Ray & Associates

(57) ABSTRACT

An apparatus for drilling trenches in the ground comprising a main frame having two vertical main faces, a drilling assembly comprising a support disposed at the bottom of said frame, means for causing said drilling assembly to move in vertical translation relative to said main frame by applying a predetermined force to said drilling assembly relative to said main frame, and anchoring means mounted on said main faces for anchoring the main frame to the walls of said trench. The anchoring means comprise a plurality of deformable elements secured to said main faces of the top frame, means for injecting a fluid under pressure into said inflatable elements thereby applying a force between said main frame and the walls of the trench, and means enabling said fluid under pressure to escape from said inflatable elements whereby no force is transmitted between said main frame and the walls of the trench.

11 Claims, 3 Drawing Sheets

DRILLING APPARATUS FOR HARD GROUND

FIELD OF THE INVENTION

The present invention relates to apparatus for using a drill to dig trenches in the ground, and in particular in ground that is very hard.

BACKGROUND OF THE INVENTION

Trench drilling apparatuses generally using two drills are well adapted to making trenches that are deep and of relatively narrow width. However, when the apparatus is required to drill into ground that is hard or very hard, such as stone, conventional machines can be found to be inadequate. The drills used at present for overburden have a maximum weight of 60 (metric) tonnes. Since such apparatuses are suspended from the end of hoisting cables, it is their own weight which is transmitted to the drills in order to perform drilling. Unfortunately, in that kind of ground, it can happen that the load required in order to achieve proper drilling lies in the range 100 tonnes to 150 tonnes, or even more. This force depends on the number of tools and the type of tool mounted on the wheels of the drill.

The simplest solution for increasing the weight of the apparatus is to load the frame of the drill. However, that would require a larger capacity hoist to be used and that naturally gives rise to major drawbacks, particularly concerning site organization.

To remedy that drawbacks, proposals have already been made in French patent No. 2 749 333 in the name of the Applicant for a particular type of drilling apparatus that enables trenches to be drilled in hard ground.

SUMMARY OF THE INVENTION

Accompanying FIG. 1 is an elevation view of the drilling apparatus described in the above-mentioned document. It comprises a main frame 10 which is suspended from the end of a pulley block 12 itself suspended from a jib. The main frame 10 has two vertical main faces, with only the front face 14 being visible. The apparatus also has a drilling assembly 16 that is movable in vertical translation at the bottom end of the main frame 10. This drilling assembly 16 essentially comprises a support structure 18 having a pump 20 mounted thereon to take up the liquid flow entraining the drilled spoil, said pump 20 being connected to a flexible removal hose. The drilling assembly also has two rotary cutters 24 and 26 secured to drums that are rotated by hydraulic motors fixed to the support assembly 18. The support assembly 18 can be moved relative to the main frame 10 by actuators 28 and 30 which serve firstly to move the drilling assembly 18 relative to the main frame 10 and secondly to apply additional force to the drilling assembly when the main frame 10 is anchored in the trench being drilled. To perform such anchoring, the main frame 10 has two shoes, of which only the shoe 32 is visible. These shoes can be moved away from the frame, e.g. by means of actuators, so as to anchor the main frame in the trench.

Such a disposition does indeed make it possible to increase the force that is applied to the cutters 24 and 26, thereby enabling them to drill into ground that is very hard. Nevertheless, given the relatively small dimensions of the active surfaces of the shoes 32 and the large force that must be developed in order to anchor the top frame, the pressure exerted by these shoes against the walls of the trench is very high. Providing the trench at the level of the shoes is of a material that is very hard, such as rock, then such pressure is acceptable. However, if the shoes are in a transition zone between relatively soft overburden that has already been drilled and rock, it is not possible to use the shoes 32 to develop the force required for achieving effective anchoring.

OBJECTS OF THE INVENTION

An object of the present invention is to provide drilling apparatus of the rotary cutter type that can be used effectively to drill a trench even in ground that is very hard and in particular when the ground has a large transition zone between relatively soft ground and very hard ground.

To achieve this object, the invention provides apparatus for drilling trenches in the ground, the apparatus comprising a main frame having two vertical main faces, a drilling assembly comprising a support disposed at the bottom of said frame, means for causing said drilling assembly to move in vertical translation relative to said main frame by applying a predetermined force to said drilling assembly relative to said main frame, and anchoring means for anchoring the main frame to the walls of said trench, said means being mounted on said main faces. The apparatus is characterized in that the anchoring means comprise a plurality of deformable elements secured to said main faces of the top frame, and means for injecting a fluid under pressure into said inflatable elements so that said inflatable elements apply a force between said main frame and the walls of the trench, and means enabling said fluid under pressure to escape from said inflatable elements whereby no force is transmitted between said main frame and the walls of the trench.

It will be understood that the presence of the inflatable elements enables the area of the trench wall against which the anchoring elements bear to be large. It is therefore possible to develop a force that is sufficient to obtain suitable anchoring of the top frame of the apparatus without excessive pressure being exerted on the walls.

In a first implementation, a plurality of strips of elastically deformable material with edges secured to the main face of the main frame are disposed on the outside faces of the inflatable elements, the inflatable elements thus being interposed between the strips and the main face of the main frame.

This serves firstly to protect the inflatable elements and secondly to transform the horizontal force developed by the inflatable elements into a vertical component that serves to compensate the force applied by the actuators on the drilling assembly. In addition, because these strips can be deformed, they can accommodate uneven shapes in the wall of the portion of the trench that has already been drilled.

In a second embodiment, a rigid plate connected to the main face of the top frame is placed facing those faces of the inflatable elements that look towards the wall of the trench. When the inflatable elements are inflated, they transmit the resultant force of their internal pressure to said plate.

This embodiment has the advantage that the anchoring force is transmitted to the wall via the rigid plate which is of large area, thereby further reducing the pressure that is applied for given anchoring force.

DESCRIPTION OF THE DRAWINGS

Other characteristics and advantages of the invention will appear better on reading the following description of various embodiments of the invention given as non-limiting examples. The description refers to the accompanying figures, in which.

DETAILED DESCRIPTION OF THE PREFERRED EMBODIMENTS

Figure 1:
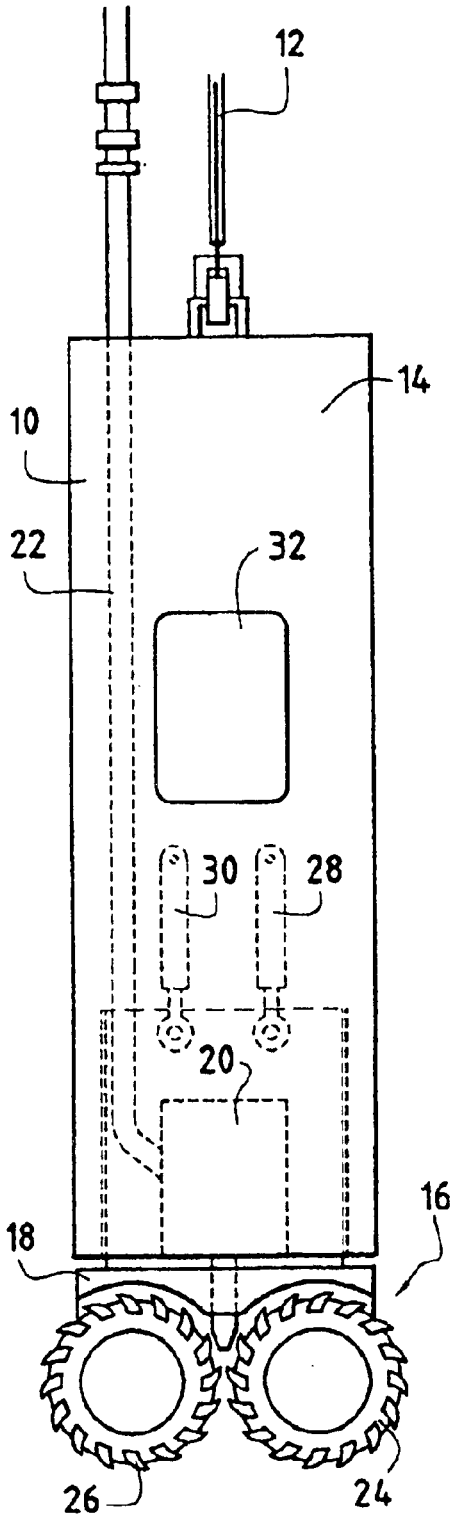
FIG.1 PRIOR ART
FIG. 1, described above, is an elevation view of a prior art drilling apparatus.
Figure 2:
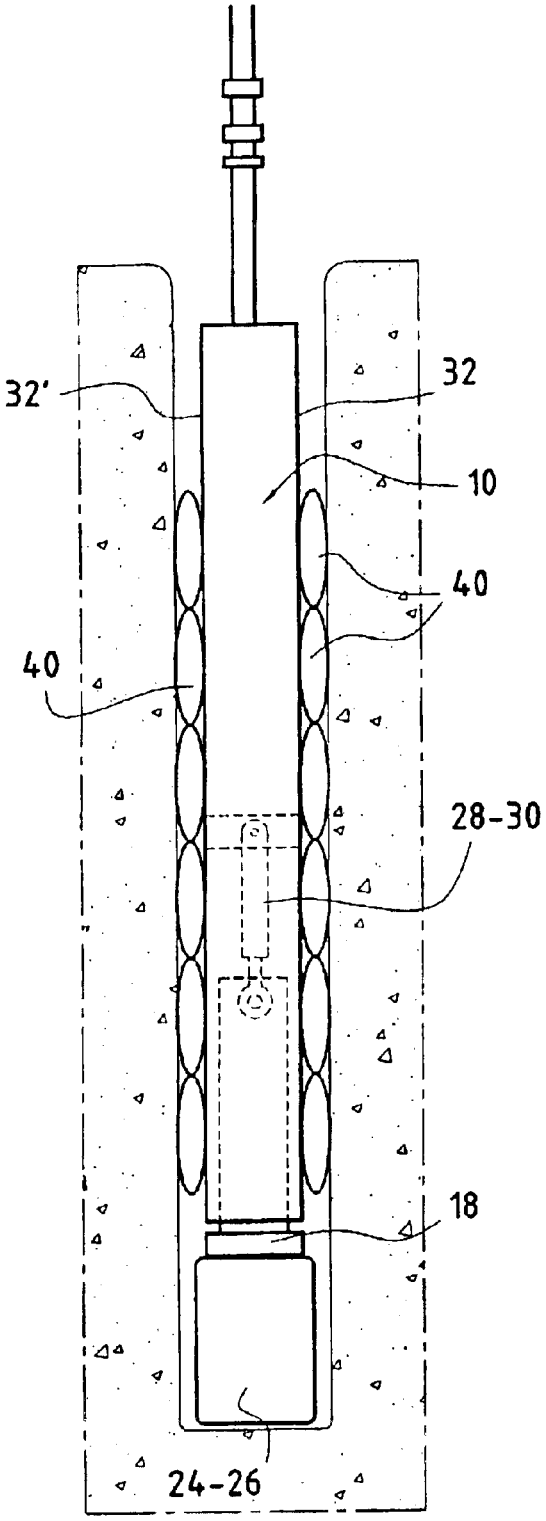
FIG. 2 is a simplified side view of a first embodiment of drilling apparatus of the invention.

The main elements of the drilling apparatus of the invention are described, initially with reference to FIG. 2. In this figure, there can be seen the top main frame 10 of the drilling apparatus with its main faces 32 and 32'. The drilling apparatus 18 and its cutter wheels 24 and 26 connected to the main frame 10 by the vertically-acting actuators 28 and 30 are represented symbolically.

In the invention, inflatable elements such as 40 are fitted over at least a portion of each of the main faces 32 and 32' of the main frame 10. By way of example, these inflatable elements occupy the entire width of these main faces and they are disposed substantially side by side. Each inflatable element 40 is constituted by an inflatable cushion defined by a wall 32 of material that is leakproof and elastically deformable. Each deformable cushion is fixed via one of its faces 42*a* to the main face 32' of the main frame and is connected to an individual inflation tube 44 which is in turn connected to a main inflation tube 46. These tubes can include adjustable pressure limiters for controlling the magnitude of the anchoring force.

Figure 3A:
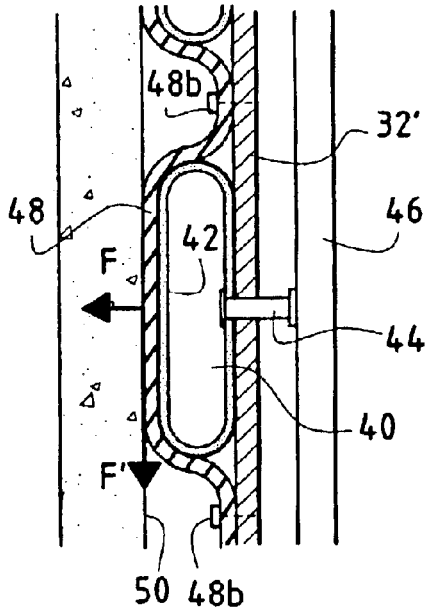
FIGS. 3A and 3B show a first embodiment of the inflatable elements respectively in the inflated state and in the non-inflated state.

In this first embodiment, as shown in greater detail in FIG. 3A, each inflatable cushion 40 is covered by a strip 48 comprising a reinforced rubbery element whose edges 48*a* and 48*b* are anchored to the wall 32' of the top frame. In this figure, there can also be seen one of the walls 50 of the trench that is being drilled. It will be understood that when a fluid (preferably a liquid) under pressure is injected into the inflatable elements 40 via the tubes 44 and 46, the volume of the inflatable element increases, thereby pressing the strip of rubbery material 48 against the wall 50. The pressure that exists inside the inflatable element 40 develops a force having a horizontal component F against the wall 50, and this force is converted into a vertical anchoring force F'. It will be understood that by placing a sufficient number of inflatable elements 40 on the main faces, it is possible to obtain a total vertical anchoring force that is very high without the pressure that is applied via the inflatable elements and the deformable strips 48 being high. This makes it possible to obtain sufficient anchoring effect even if the nature of the material in which this portion of the trench has been drilled is of limited strength.

Figure 3B:
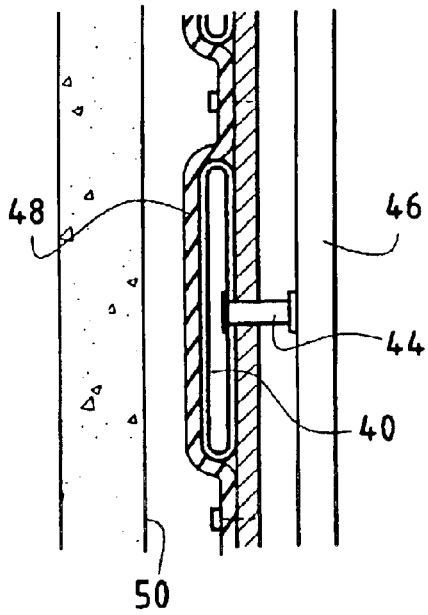

However, as shown in FIG. 3B, when the inflatable element 40 is no longer under pressure, the strip 48 is moved away from the inside wall 50 of the trench and the drilling apparatus can be moved so as to drill a new section of trench.

Figure 4A:
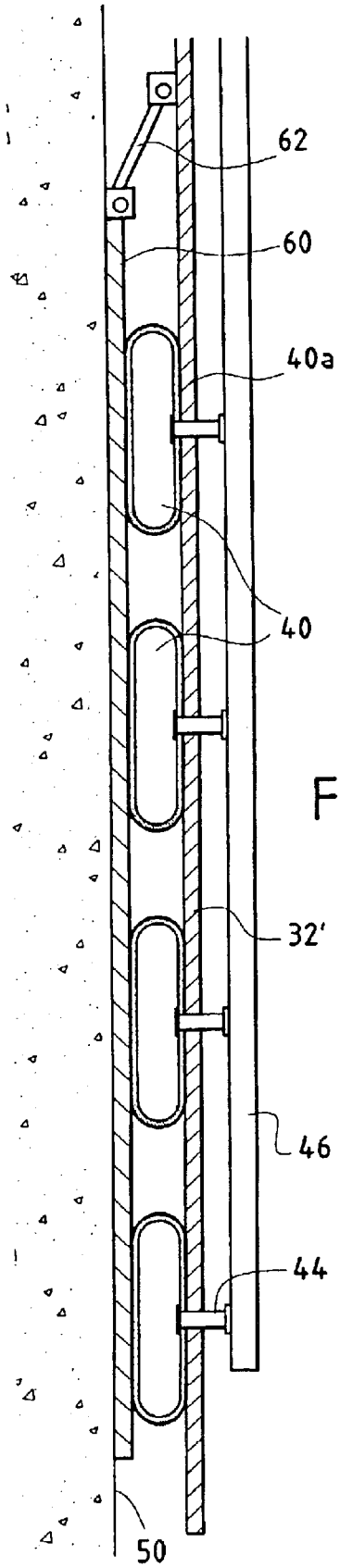
FIGS. 4A to 4B show a second embodiment of the inflatable elements respectively in the inflated state and in the non-inflated state.
Figure 4B:
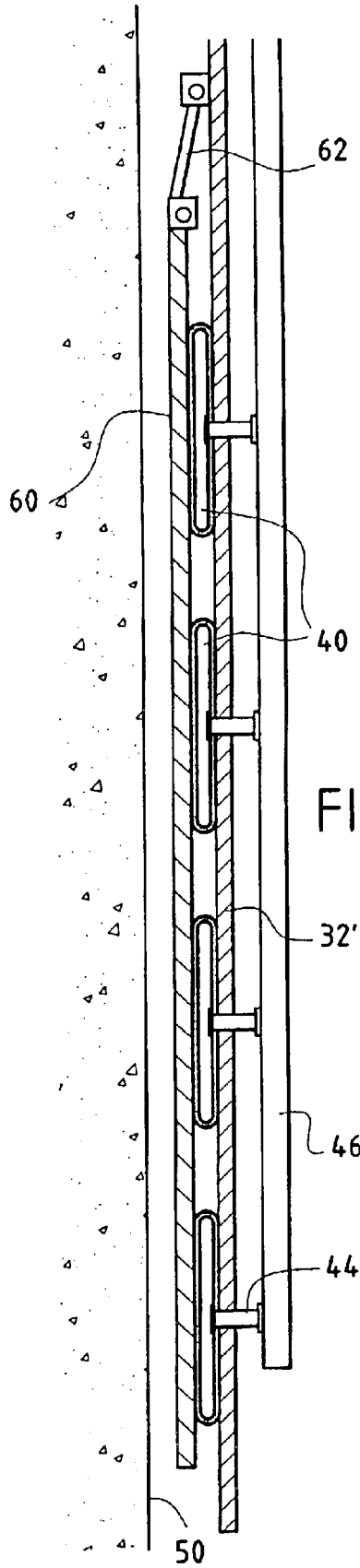

Reference is now made to FIGS. 4A and 4B to describe a second embodiment of the anchoring means.

These are constituted by inflatable elements 40 e.g. comprising inflatable cushions identical to those shown in FIGS. 3A and 3B. These cushions 40 are fixed via one face to the wall 32' of the main frame and they are connected to pressurized fluid tubes. In this second embodiment, a rigid plate 60 covering the entire surface area occupied by the inflatable elements 40 is secured to the wall 32' via a hinged linkage 62. By way of example, the linkage 62 can be constituted by a connecting rod, or more exactly a plurality of connecting rods, and is disposed above the top inflatable cushion 40*a*. It will be understood, that when the inflatable elements 40 are indeed inflated, the rigid plate 60 is applied with pressure against the wall 50 of the trench. This makes it possible to obtain an anchoring force that is large while applying only limited pressure to the wall of the trench because the plate 60 of large surface area is pressed continuously against the wall of the trench.

What is claimed is:

1. Apparatus for drilling trenches in the ground, said apparatus comprising a vertical main frame having two vertical main faces, a drilling assembly comprising a support disposed at the bottom of said frame, means for causing said drilling assembly to move in vertical translation relative to said main frame by applying a predetermined force to said drilling assembly relative to said main frame, and anchoring means for anchoring said main frame to the walls of said trench, said anchoring means comprising a plurality of inflatable elements, each inflatable element being secured to one of said main faces of the main frame, so that said inflatable elements are disposed between said main faces and the walls of the trench, means for injecting a fluid under pressure into said inflatable elements so that said inflatable elements apply a force between said main faces of said main frame and the walls of the trench, and means enabling said fluid under; pressure to escape from said inflatable elements whereby no force is transmitted between said main frame and the walls of the trench.

2. Drilling apparatus according to claim 1, characterized in that a strong layer that is movable under the effect of inflating the inflatable elements is placed on the face of each inflatable element that faces towards the walls of the trench.

3. Drilling apparatus according to claim 2, characterized in that said moving layer is constituted by a plurality of strips of elastically deformable material whose edges are secured to one of the main faces of the main frame, with at least one inflatable element being interposed between said strip and said main face.

4. Drilling apparatus according to claim 2, characterized in that said moving layer is constituted by a rigid plate connected to said main face by mechanical means enabling said plate to move in a direction orthogonal to said main face, said inflatable elements being interposed between said main face and said plate.

5. Drilling apparatus according to claim 1, characterized in that said inflatable elements are inflatable cushions made of a material that is leakproof and elastically deformable.

6. Drilling apparatus according to claim 1, characterized in that said inflatable elements are inflatable cushions made of a material that is leakproof and elastically deformable.

7. Drilling apparatus according to claim 2, characterized in that said inflatable elements are inflatable cushions made of a material that is leakproof and elastically deformable.

8. Drilling apparatus according to claim 3, characterized in that said inflatable elements are inflatable cushions made of a material that is leakproof and elastically deformable.

9. Drilling apparatus according to claim 4, characterized in that said inflatable elements are inflatable cushions made of a material that is leakproof and elastically deformable.

10. Apparatus for drilling trenches in the ground, said apparatus comprising a vertical main frame having two vertical main faces, a drilling assembly comprising a support disposed at the bottom of said frame, means for causing said drilling assembly to move in vertical translation relative to said main frame by applying a predetermined force to said drilling assembly relative to said main frame, and anchoring means for anchoring said main frame to the walls of said trench, said anchoring means comprising a plurality of inflatable elements, each inflatable element being secured to one of said main faces of the main frame, so that said inflatable elements are disposed between said main faces and the walls of the trench, a strong layer that is movable under the effect of inflating the inflatable elements and placed on the face of each inflatable element that faces towards the walls of the trench, said moving layer being constituted by a plurality of strips of elastically deformable material whose edges are secured to one of the main faces of the main frame, with at least one inflatable element being interposed between said strip and said main face, means for injecting a fluid under pressure into said inflatable elements so that said inflatable elements apply a force between said main faces of said main frame and the walls of the trench, and means enabling said fluid under pressure to escape from said inflatable elements whereby no force is transmitted between said main frame and the walls of the trench.

11. Apparatus for drilling trenches in the ground, said apparatus comprising a vertical main frame having two vertical main faces, a drilling assembly comprising a support disposed at the bottom of said frame, means for causing said drilling assembly to move in vertical translation relative to said main frame by applying a predetermined force to said drilling assembly relative to said main frame, and anchoring means for anchoring said main frame to the walls of said trench, said anchoring means comprising a plurality of inflatable elements, each inflatable element being secured to one of said main faces of the main frame, so that said inflatable elements are disposed between said main faces and the walls of the trench, a strong layer that is movable under the effect of inflating the inflatable elements is placed on the face of each inflatable element that faces towards the walls of the trench, said moving layer being constituted by a rigid plate having an upper edge and connecting means for connecting said upper edge of said rigid plate to said main face of the main frame above said inflatable elements so that said plates can be moved perpendicularly to said main faces, means for injecting a fluid under pressure into said inflatable elements so that said inflatable elements apply a force between said main faces of said main frame and the walls of the trench, and means enabling said fluid under pressure to escape from said inflatable elements whereby no force is transmitted between said main frame and the walls of the trench.

* * * * *